US007090148B2

(12) United States Patent
Petrie et al.

(10) Patent No.: US 7,090,148 B2
(45) **Date of Patent: *Aug. 15, 2006**

(54) MIXING CUP ADAPTING ASSEMBLY

(75) Inventors: Robert M. Petrie, Plymouth, MN (US); Stephen C. P. Joseph, Nr. Nuneaton (GB); Keith C. Navis, White Bear Lake, MN (US); David C. Roeker, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 90 days.

This patent is subject to a terminal disclaimer.

(21) Appl. No.: 10/453,413

(22) Filed: Jun. 3, 2003

(65) Prior Publication Data

US 2004/0016825 A1 Jan. 29, 2004

Related U.S. Application Data

(63) Continuation of application No. 10/139,887, filed on May 6, 2002, now Pat. No. 6,595,441, which is a continuation of application No. 09/374,794, filed on Aug. 16, 1999, now Pat. No. 6,536,687.

(51) Int. Cl.
*B05B 7/30* (2006.01)

(52) U.S. Cl. ..... 239/345; 239/600

(58) Field of Classification Search ..... 239/345, 239/340, 337, 347, 350, 318, 378, 600; 222/189.06, 222/481, 158, 482; 141/383, 346, 385, 384; 285/361, 24, 307, 319, 360, 376, 401
See application file for complete search history.

(56) References Cited

U.S. PATENT DOCUMENTS 856,361 A 6/1907 Neiburg
1,476,668 A 12/1923 Agnew, Sr.
2,263,843 A 11/1941 Gross
2,612,404 A 9/1952 Andersson
2,770,706 A 11/1956 Vogtle et al.
2,801,880 A 8/1957 Rienecker
2,901,182 A 8/1959 Cragg et al.
3,236,459 A 2/1966 McRitchie
4,411,397 A 10/1983 Karsh et al.
4,773,569 A 9/1988 Larsson (Continued)

FOREIGN PATENT DOCUMENTS

CH 653 54 A5 1/1986

(Continued)

*Primary Examiner*—Christopher Kim
(74) *Attorney, Agent, or Firm*—William L. Huebsch

(57) ABSTRACT

An assembly for feeding liquid to the inlet port of a gravity feed sprayer. The assembly includes (1) a mixing cup of a known type commonly used to mix paint with solvent that is of stiff polymeric material and bears indicia on its side wall indicating the levels to which a plurality of different liquids should be sequentially poured into the cup to achieve a predetermined ratio between the liquids; (2) a first adapter comprising a central portion having a through opening and a transverse portion including a peripheral part defining a groove along its inner surface adapted for sealing engagement with a top end of the mixing cup; and (3) a second adapter having a through opening, a first end portion of which second adapter is adapted to releasably engage the inlet port of a gravity feed paint sprayer. A second end portion of the second adapter and the central portion of the first adapter have connector parts adapted for releasable liquid tight engagement between the adapters with their through openings in communication.

11 Claims, 5 Drawing Sheets

U.S. PATENT DOCUMENTS

| | | | | |
|---|---|---|---|---|
| 4,811,904 | A | | 3/1989 | Ihmels et al. |
| 4,946,075 | A | | 8/1990 | Lundbäck |
| 4,993,639 | A | | 2/1991 | Hata |
| 5,069,389 | A | | 12/1991 | Bitsakos |
| 5,271,683 | A | | 12/1993 | Snetting et al. |
| 5,318,332 | A | * | 6/1994 | Hohmann et al. ..... 285/24 |
| 5,601,212 | A | | 2/1997 | Lee |
| 5,803,367 | A | | 9/1998 | Heard et al. |
| 6,165,159 | A | | 12/2000 | Blanton |
| 6,536,687 | B1 | | 3/2003 | Navis et al. |

FOREIGN PATENT DOCUMENTS

| | | |
|---|---|---|
| DE | 210449 | 2/1907 |
| DE | 24 12 743 | 9/1975 |
| GB | 23826 | 6/1913 |
| WO | WO 98/32539 | 7/1998 |

* cited by examiner

MIXING CUP ADAPTING ASSEMBLY

CROSS REFERENCE TO RELATED APPLICATION

This application is a continuation of U.S. patent application Ser. No. 10/139,887 filed May 6, 2002, now U.S. Pat. No. 6,595,441, which was a continuation of U.S. patent application Ser. No. 09/374,794 filed Aug. 16, 1999, now U.S. Pat. No. 6,536,687 issued Mar. 25, 2003.

FIELD OF THE INVENTION

The present invention relates to the liquid supply assemblies for gravity fed liquid (e.g., paint) spraying devices or spray guns.

BACKGROUND OF THE INVENTION

Various liquid supply assemblies have been described for use with gravity fed liquid (e.g., paint) spraying devices or spray guns, including those described in the international application published as International Publication Number WO 98/32539 on Jul. 30, 1998, the content whereof is incorporated herein by reference. The supply assembly including a collapsible liner that is described and claimed in that application should provide advantages over the prior art liquid supply assembly also described in that application.

DISCLOSURE OF THE INVENTION

The present invention provides a liquid supply assembly for use with gravity fed liquid spraying devices that, like the liquid supply assembly described and claimed in WO 98/32539, should also provide advantages over the prior art liquid supply assembly described in that application.

According to the present invention there is provided a liquid supply assembly adapted for use on a gravity fed liquid spraying device that comprises (1) a mixing cup of stiff polymeric material that bears indicia on its side wall indicating the levels to which a plurality of different liquids should be sequentially poured into the cup to achieve a predetermined ratio between the liquids; (2) a first adapter comprising a central portion having a through opening and a transverse portion including a peripheral part defining a groove along its inner surface adapted for sealing engagement with a top end of the mixing cup; (3) a second adapter having a through opening, a first end portion adapted to releasably engage the inlet port of the spraying device; and a second end portion having a connector part adapted for releasable liquid tight engagement with a connector part on the central portion of the first adapter with the through openings in communication.

The mixing cup is of a known type commonly used in paint shops to mix different paints and/or to mix paint with solvent. Those liquids are mixed using indicia on the side walls of the mixing cup. That indicia indicates the levels to which two or three different liquids should be sequentially poured into the mixing cup to provide a predetermined ratio between those liquids, such indicia being provided for a plurality of different ratios. Prior to this invention, liquid from the mixing cup was poured into a liquid supply assembly for a spray gun, and if liquid remained after the spraying operation was complete, that remaining liquid was sometimes poured back into the mixing cup, an air tight cover was applied thereto, and the liquid (e.g., paint) was stored for future use in the covered mixing cup.

The present invention affords further use of that mixing cup as part of the liquid supply assembly for the spraying device. This eliminates the need to pour the mixed liquid (e.g., paint) out of the mixing cup prior to spraying, or to pour unsprayed liquid back into the mixing cup after the spraying operation. Instead, the liquid is mixed in the mixing cup, remains in the mixing cup during the spraying operation when the mixing cup becomes part of the liquid supply assembly for the spraying device, and if unsprayed liquid remains after the spraying operation, it can be retained in the mixing cup which is then separated from the rest of the liquid supply assembly and can have a conventional air tight cover applied to it for storage.

A vacuum relief for the liquid supply assembly can be provided by inserting a tapered removable pin (e.g., a pin of the type sometimes called a "push pin") through the side wall of the mixing cup adjacent its bottom wall. That pin is removed during use of the mixing cup in the liquid supply assembly for the spraying device when the mixing cup is positioned with its bottom wall uppermost so that air can enter the cup through an air passageway formed by the pin above the liquid being supplied to the spraying device. Before and after the spraying operation when the cup is supported on its bottom wall that pin may be positioned in the passageway it forms to preclude liquid leaking out of the mixing cup through that passageway.

The liquid supply assembly can also include a removable filter assembly for filtering liquid leaving the mixing cup during the spraying operation.

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
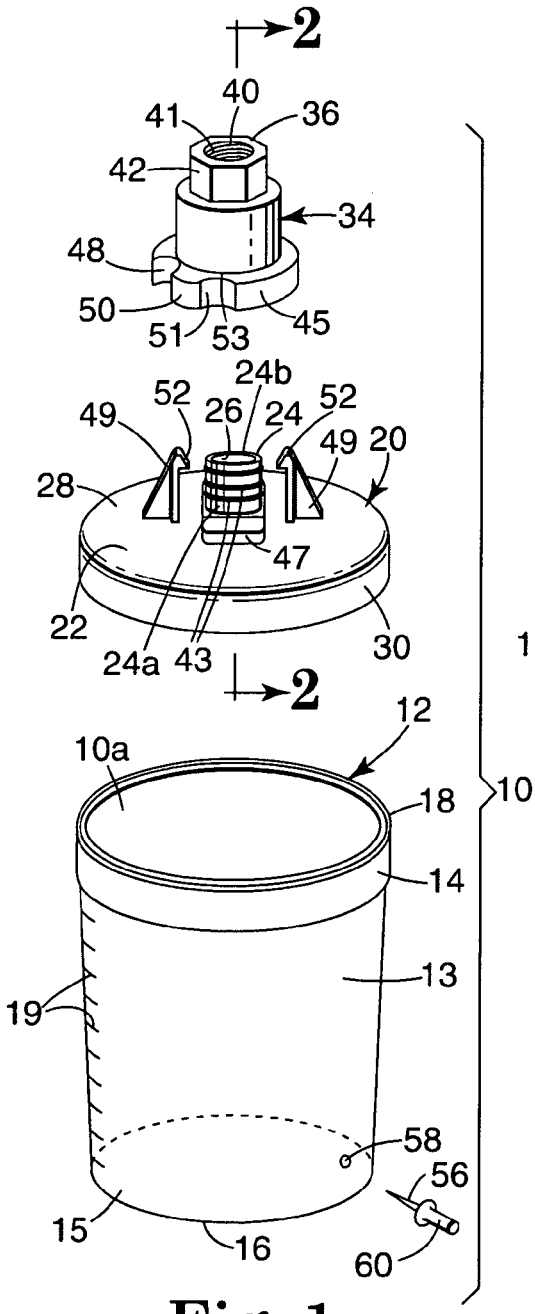
FIG. 1 is an exploded perspective view of a liquid supply assembly according to the present invention.
Figure 2:
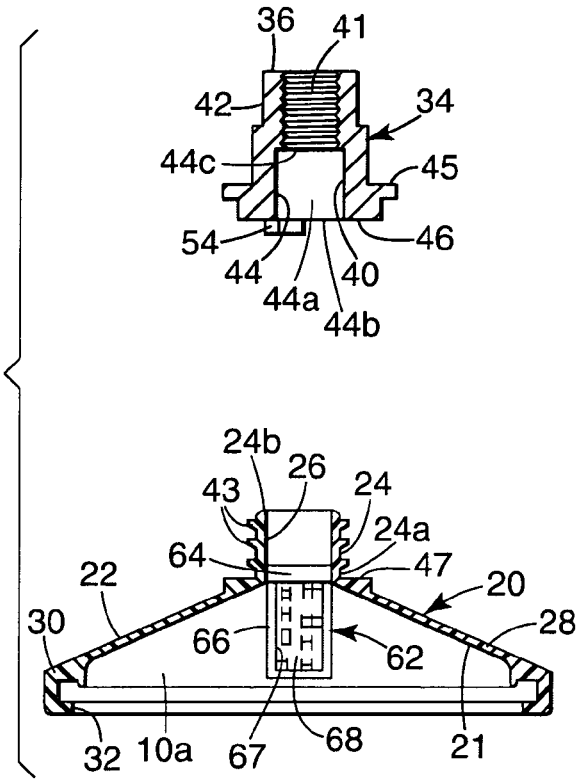
FIG. 2 is an enlarged sectional view taken approximately along section line 2—2 of FIG. 1.
Figure 4:
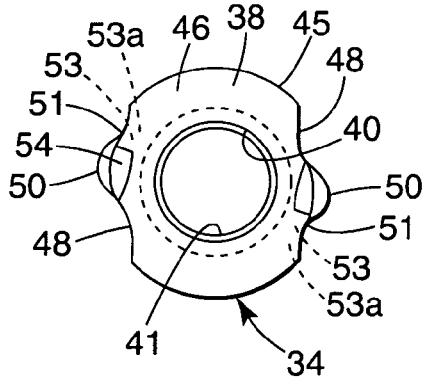
FIG. 4 is an end view of the second adapter illustrated in FIGS. 1, 3, and 3*a;*

Referring now to the drawing there is illustrated a liquid supply assembly generally designated by the reference numeral 10 that (as is illustrated in FIGS. 3, 3*a* 5 and 6) can be used to supply liquid for a conventional gravity fed liquid spraying device or spray gun 11 having a through liquid passageway 11*a* for liquid to be sprayed (e.g., the spray gun commercially designated NR 95 that is available from Sata, Farbspritzechnik GmbH & Co., Kornwestheim, Germany), thereby providing a novel gravity fed liquid spraying apparatus.

As is best seen in FIGS. 1, and 3, 3*a*, 5, and 6, the liquid supply assembly 10 includes walls forming a liquid supply chamber 10*a* including walls forming a cup portion or conventional paint mixing cup 12 of stiff polymeric material (e.g., the polyethylene mixing cups commercially available from PPG, Cleveland, Ohio, which can be obtained in 8 ounce or 240 ml, or 16 ounce or 480 ml, or 24 ounce or 720 ml, or 32 ounce or 960 ml sizes). The cup portion or paint mixing cup 12 comprises a generally cylindrical side wall 13 having a first or top end 14, a second or bottom end 15, a bottom wall 16 extending across and closing the second or bottom end 15 of the side wall 13, and an outwardly projecting lip 18 around the first or top end 14 of the side wall 13. The first or top end 14 of the side wall 13 defines an opening into the cup portion 12. The side wall 13 bears indicia 19 indicating the levels to which two or three different liquids should be sequentially poured into the cup portion 12 through that opening to provide a predetermined ratio between those liquids, that indicia 19 being provided for a plurality of different ratios. The side wall 13 is sufficiently translucent to afford seeing the liquid level in the cup portion 12 through the side wall 13 which assists a person in adding liquids to the desired levels indicated by the indicia 19.

The liquid supply assembly 10 also includes a first adapter 20, (see FIGS. 1, 2, 3, and 3*a*) preferably molded of polymeric material (e.g., polyethylene), having opposite inner and outer major surfaces 21 and 22. The first adapter 20 comprises a central generally cylindrical projecting portion 24 having an axis, opposite axially spaced proximal and distal ends 24*a* and 24*b*, and a through opening or liquid passageway 26 between its ends 24*a* and 24*b*. The first adapter 20 also comprises a transverse portion or wall 28 including a peripheral part 30, which transverse wall 28 is included in the walls defining the liquid supply chamber 10*a*. The proximal end 24*a* of the cylindrical portion 24 is attached to the transverse portion or wall 28 with the liquid passageway 26 opening through the transverse portion or wall 28. The transverse portion or wall 28 has a groove 32 along its inner surface that is adapted for sealing engagement with the first or top end 14 and the outwardly projecting lip 18 of the side wall 13 of the paint mixing cup or cup portion 12.

Figure 3:
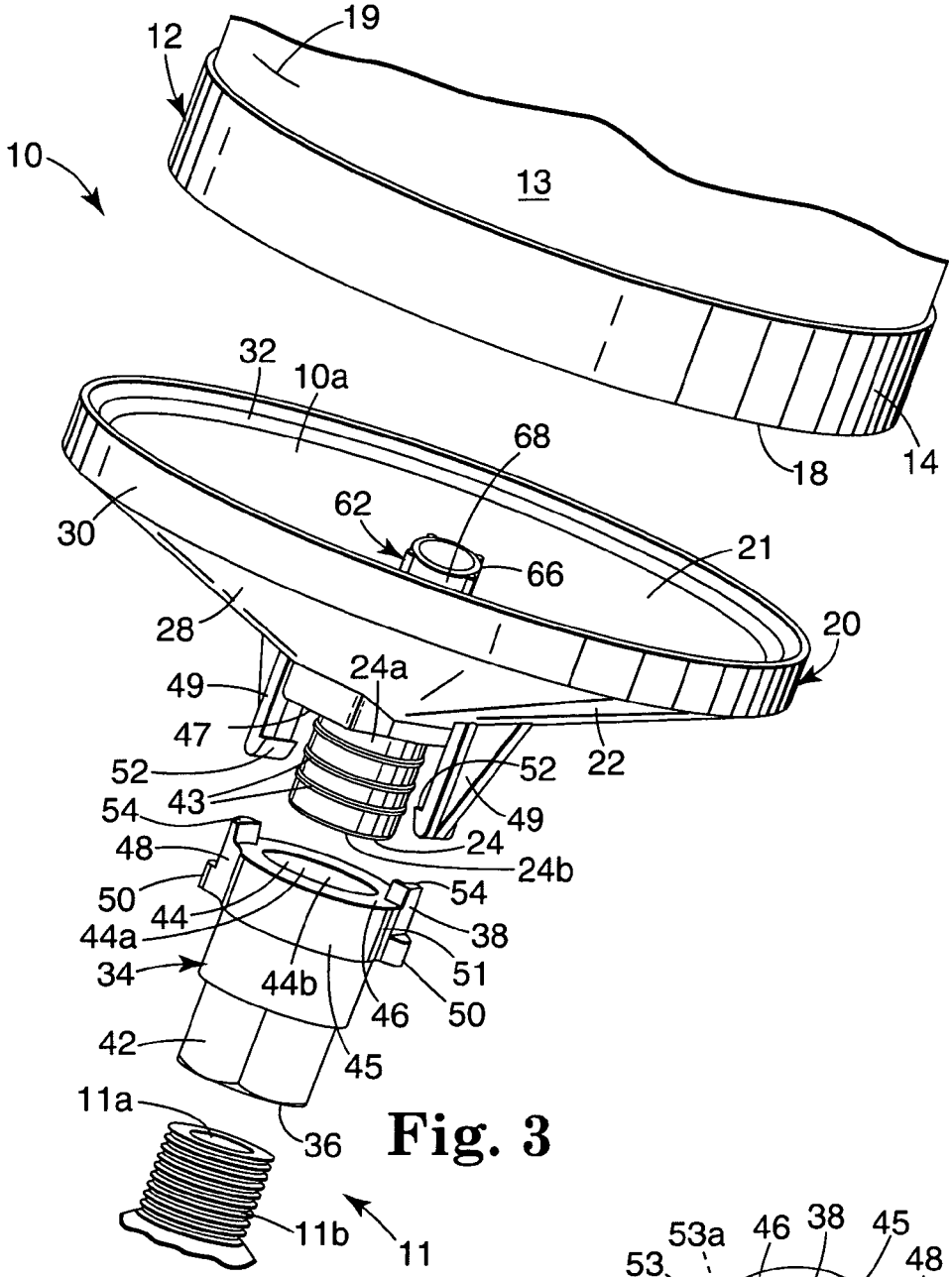
FIG. 3 is an enlarged exploded perspective view of the liquid supply assembly of FIG. 1 together with a fragment of a spraying device or spray gun to which the liquid supply assembly is adapted to be attached to form a gravity fed liquid spraying apparatus.
Figure 3A:
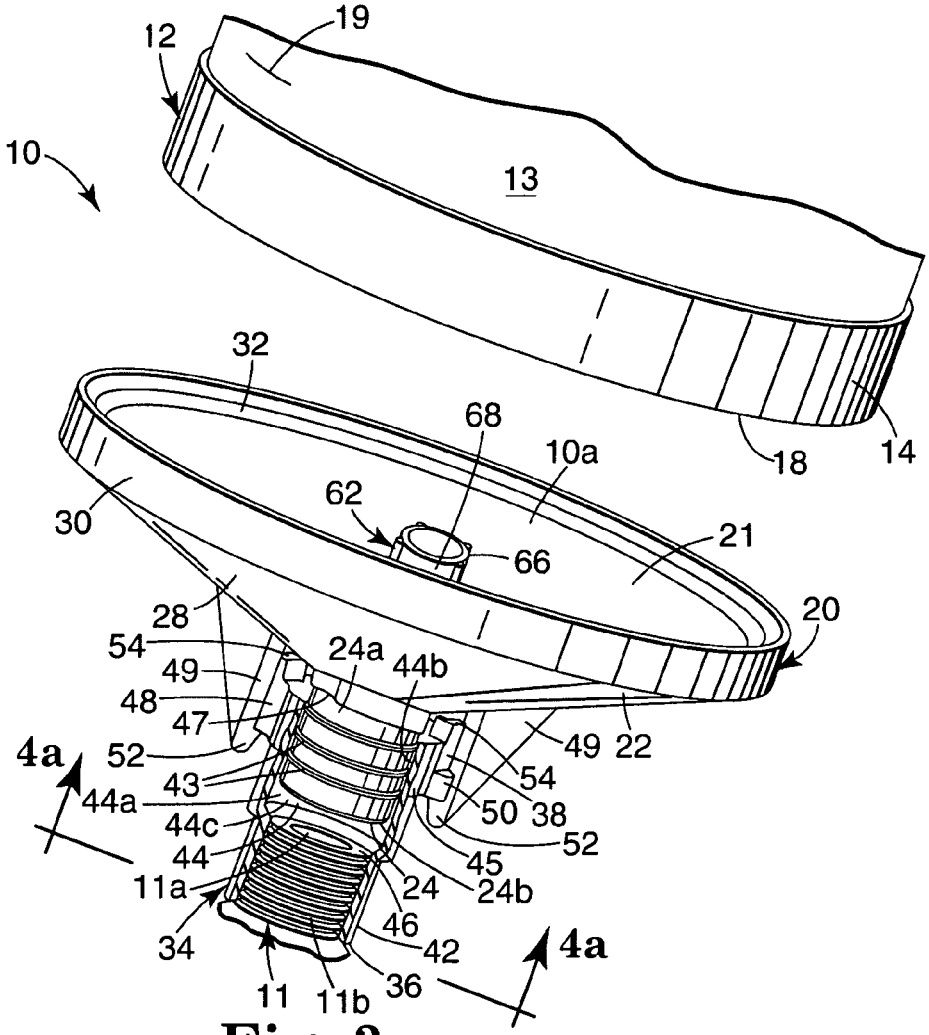
FIG. 3*a* is a perspective view with a part broken away and sectioned to show detail, which view generally corresponds to FIG. 3 except that a second adapter illustrated in FIGS. 1 and 3 is attached to the fragment illustrated in FIG. 3 to thereby incorporate the second adapter in the spraying device or spray gun, and a cylindrical portion included in the liquid supply assembly is in an engaged position in a bore in the second adapter.
Figure 4A:
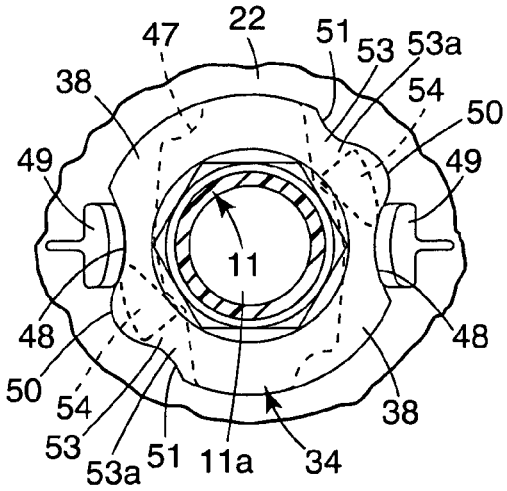
FIG. 4*a* is an enlarged sectional view taken approximately along section line 4*a*—4*a* of FIG. 3*a;*
Figure 4B:
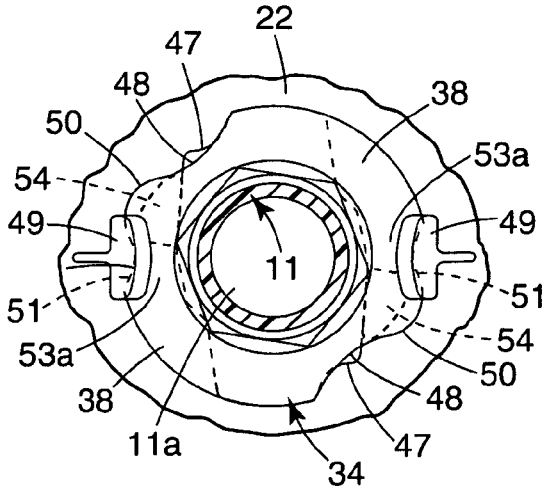
FIG. 4*b* is an enlarged sectional view taken approximately along section line 4*b*—4*b* of FIG. 6.
Figure 5:
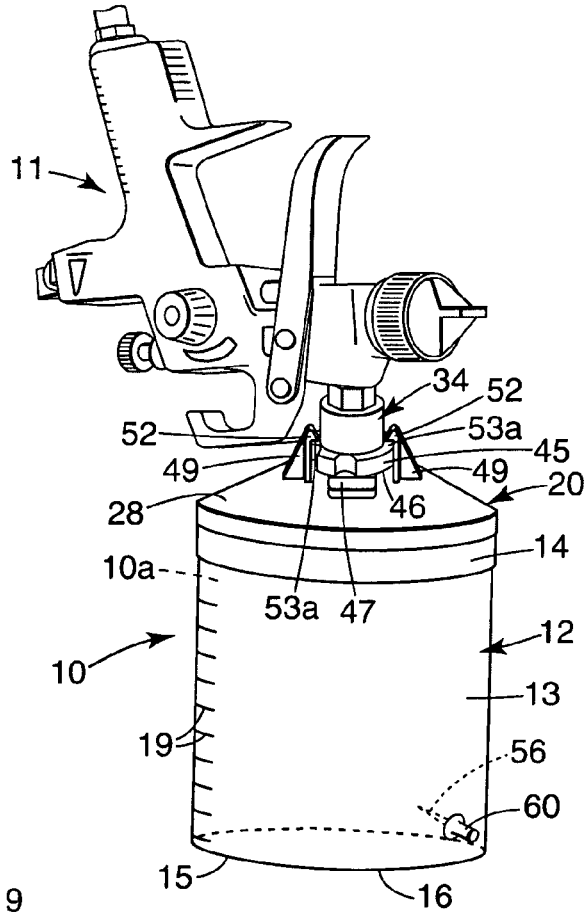
FIG. 5 is a perspective view of the liquid supply assembly of FIG. 1 attached to an inverted spraying device or spray gun to form the gravity fed liquid spraying apparatus.
Figure 6:
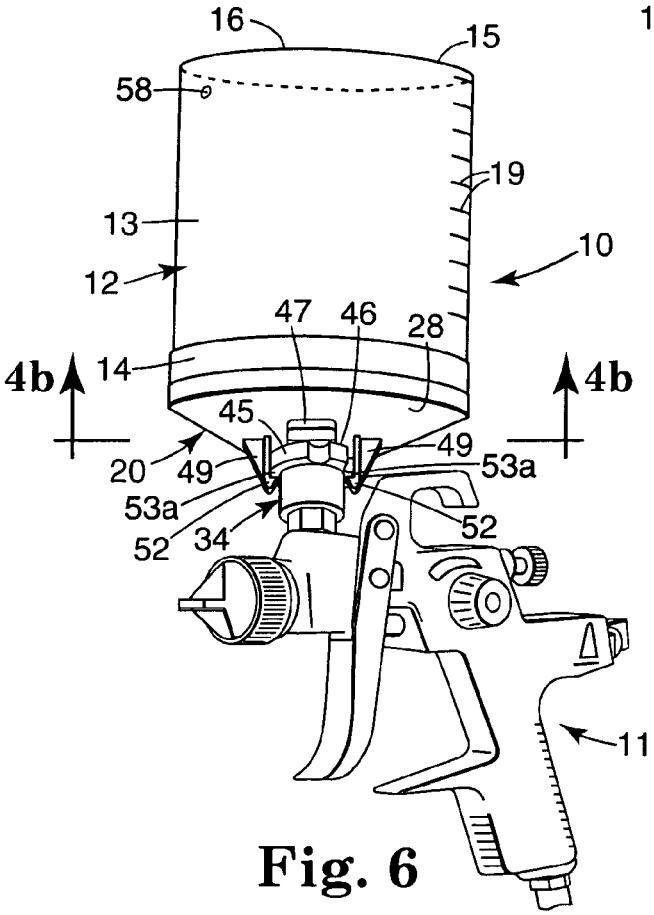
FIG. 6 is a perspective view of the gravity fed liquid spraying apparatus illustrated in FIG. 5 in the position used for spraying liquid with the spraying apparatus.

A second adapter or connector portion 34 (see FIGS. 1, 2, 3, 3*a* 4, 4*a*, 4*b* ), also included in the liquid supply assembly 10, is preferably of metal (e.g., aluminum), has first and second spaced end portions 36 and 38, and has a through opening 40 extending through those end portions 36 and 38. The first end portion 36 of the second adapter 34 has internal threads 41 and six flatted wrench engageable surface portions 42 around its periphery, thereby being adapted to be releasably engaged with external threads 11*b* around an inlet port to the through liquid passageway 11*a* of the gravity feed spray gun 11 so that upon such engagement the second adapter becomes part of the spray gun 11. The first adapter 20 and the second end portion 38 of the second adapter or connector portion 34 have connector parts or portions that are adapted for releasable liquid tight engagement with their through openings 26 and 40 in communication. Those connector parts or portions include axially spaced radially outwardly projecting sealing rings 43 along the outer surface of the cylindrical projecting portion 24, and a cylindrical inner surface 44 of the second adapter or connector portion 34 that defines a cylindrical bore 44*a* having an outer end 44*b* opening through the distal end of the second adapter or connector portion 34 opposite the threads 41 at the topside of the spray gun 11. As is best illustrated in FIGS. 3*a*, 5, and 6. that bore 44*a* is adapted to receive the cylindrical projecting portion 24 of the of the first adapter 20 in an engaged co-axial position with the distal end 24*b* of the cylindrical portion 24 adjacent an inner end 44*c* of the bore 44*a*. with the sealing rings 43 in slightly compressed liquid tight engagement with the inner surface 44 defining the bore 44*a* to thereby provide sealing means for providing liquid tight engagement between the cylindrical portion 24 of the liquid supply assembly 10 and the cylindrical surface 44 defining the bore 44*a* when the cylindrical portion 24 is within the bore 44*a* in the engaged position, and with an end surface 46 on a collar 45 around the second end portion 38 of the second adapter 34 abutting a boss 47 in the first adapter 20 around the proximal end 24*a* of the cylindrical projecting portion 24. The first adapter 20 is a unitary polymeric molded assembly including the transverse portion or wall 28. the cylindrical projecting portion 24, and hooks or second coupling members 49 projecting from the transverse portion 28 on opposite sides of the cylindrical projecting portion 24. The collar 45 has major cylindrically concave recesses 48 along opposite sides of its periphery (see FIGS. 1, 3, 3*a*, 4, 4*a*, and 4*b*) adapted to pass the distal ends of the hooks or second coupling members 49 projecting from the transverse portion or wall 28 of the first adapter 20 on opposite sides of the cylindrical projecting portion 24 when the cylindrical projecting portion 24 is pressed axially into the bore 44*a* to the engaged position with the first and second adapters 20 and 34 co-axial and in a first relative rotated position at which the hooks or second coupling members 49 are aligned with the major recesses 48 in the collar 45 (see FIG. 4*a*). After thusly being pressed to the engaged position, the first adapter 20 of the liquid supply assembly 10 and the spray gun 11 can be rotated relative to each other to thereby rotate the adapter 20 and the connector portion 34 relative to each other to a second relative position to cause the resiliently flexible projecting hooks or second coupling members 49 to be deflected outwardly by, and to move around, cylindrically convex cam lobes 50 projecting radially outwardly on corresponding sides of the major recesses 48 until the projecting hook members 49 are positioned in minor cylindrically concave recesses 51 in the collar 45 (see FIG. 4*b*) at which position opposed inwardly projecting lips 52 on the distal ends of the projecting hooks or second coupling members 49 are engaged over a retaining surface 53 on the collar 45 adjacent the first end 36 of the second adapter 34. That retaining surface 53 is on a portion of the collar 45 that provides a first coupling member 53*a* on the connector portion 34 that is external to the bore 44*a*, adjacent the outer end of the bore 44*a*, and is fixed relative to the cylindrical surface 44 defining the bore 44*a*. Such engagement of the second coupling members 49 with the first coupling members 53*a* retains the cylindrical portion 24 in the bore 44*a* in the engaged position. Subsequently, the first adapter 20 of the liquid supply assembly 10 can be separated from the spray gun 11 by rotating them relative to each other to thereby rotate the adapter 20 and the connector portion 34 relative to each from their second relative position to their first relative position, and then withdrawing the cylindrical portion 24 from the bore 44*a* as the distal ends of the hooks or second coupling members 49 pass through the major recesses 48 in the collar 45. Lugs 54 projecting axially past the end surface 46 of the collar 45 are adapted to move between positions engaging sides of the boss 47 on the first adapter 20 when the cylindrical projecting portion 24 is in its engaged position in the bore defined by the inner surface 44, thereby limiting relative movement between the adapters 20 and 34 to movement to and between those first and second relative positions.

The liquid supply assembly 10 further includes a tapered, pointed, removable pin 56 (e.g., a pin of the type sometimes called a "push pin") extending through a passageway 58 in the side wall 13 of the cup 12 adjacent its bottom wall 16 (see FIGS. 1 and 5). On the end of the pin 56 opposite its point is a molded head 60 by which the pin 56 can be manually pressed through the side wall 13 to form the passageway 58. When the cup 12 is inverted to supply liquid to the spray gun 11 as is illustrated in FIG. 6, the pin 56 can be removed so that the passageway 58 will provide vacuum relief for the cup 12 by then allowing air to enter the cup 12 through the passageway 58 above the liquid (e.g., paint) being supplied to the spray gun 11. Before and after any such spraying operations that pin 56 may be positioned in the passageway 58 as is illustrated in FIG. 5 to preclude liquid within the cup 12 from leaking through the passageway 58 when the cup is supported on its bottom wall 16.

The combination 10 can also include a removable filter assembly 62 (see FIGS. 2 and 3) of a known commercially available type (e.g., the filter commercially designated "paint filter kit" that is commercially available from Standard Color, St. Paul, Minn.). The filter assembly 62 includes a stiff polymeric frame comprising a cylindrical outlet portion 64 having a cylindrical outer surface frictionally engaged within the inner surface defining the through opening 26 in the central projecting portion 24, which outlet portion 64 has a through opening. The frame of the filter assembly 62 further includes an inlet portion 66 projecting from the inner surface 21 of the transverse portion 28 of the first adapter 20. The inlet portion 66 has four axially extending rectangular inlet passageways 67 spaced around its periphery that communicate with the through opening in the outlet portion 64, and includes a filter screen 68 extending across the inner ends of those inlet passageways 67.

Figure 7:
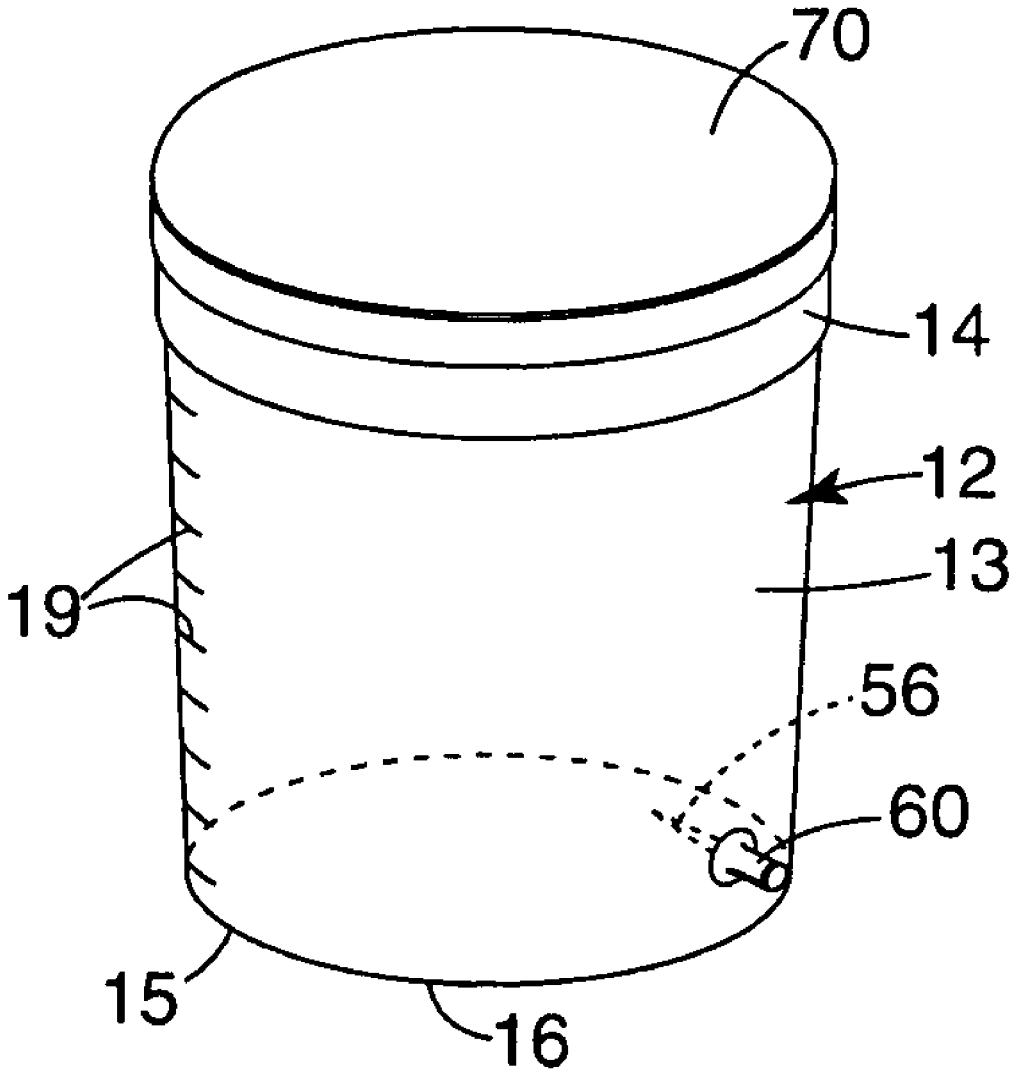
FIG. 7 is a perspective view of a mixing cup included in the liquid supply assembly of figure 1, which mixing cup has been separated from the rest of the liquid supply assembly and has had a conventional cover applied to it.

A method according to the present invention for providing a supply of mixed liquids for the gravity fed liquid spraying device 11 includes mixing the liquids in the mixing cup 12 using the indicia 19 to indicate the levels to which the liquids should be sequentially poured into the cup 12 to achieve the desired ratio between the liquids; engaging the pcripheral part 30 of the first adapter 20 with the top end 14 of the mixing cup 12 containing the mixed liquids; engaging the first end 36 of the second adapter 34 with the inlet port of the liquid spraying device 11 (if this has not already been done); engaging the connector pans as described above (this being done with the mixing cup supportcd on its bottom wall and the spraying device inverted as illustrated in FIG. 5); and positioning the spraying device 11 as illustrated in FIG. 6 so that the bottom wall 16 of the mixing cup 12 is uppennost to feed the liquid in the mixing cup 12 to the spraying device 11 through the filter assembly 62 and the openings 26 and 40 in the adapters 20 and 34. That method can further include inserting the tapered pin 56 through the side wall 13 of the mixing cup 12 adjacent its bottom wall 16, and removing the tapered pin 56 from the side wall 13 after the spraying device 11 is positioned with the bottom wall 16 of the mixing cup 12 uppermost as illustrated in FIG. 6 to feed the liquid in the mixing cup 12 to the spraying device. Such insertion of the tapered pin 56 provides the passageway 58 through the side wall 13 of the mixing cup 12 adjacent its bottom wall 16 so that air can flow into the cup 12 through the passageway 58 as the liquid is sprayed to restrict causing a vacuum in the mixing cup 12. If liquid remains in the mixing cup 12 after use of the liquid spraying device 11, the pin 56 can be inserted through the passageway 58 to restrict leakage of liquid through the passageway 58; the spraying device 11 can again be inverted to the position illustrated in FIG. 5, the connector parts can be disconnected, the first adapter 20 can be removed from the top end 14 of the mixing cup 12 containing the remaining liquid; a conventional cover 70 (see FIG. 7) can be applied to the top end 14 of the mixing cup 12, and the remaining liquid can be stored for future use in the covered mixing cup 12. The incxpensive first adapter 20 and the filtcr assembly 52 can then be disposed of so that cleunup of the liquid supply assembly 10 only requires cleaning the second adapter 34, which is cleaned with the spray gun 11.

The present invention has now been described with reference to one embodiment thereof. It will be apparent to those skilled in the art that many changes can be made in the embodiment described without departing from the scope of the present invention. For example, any of a number of different types of connectors can be used between the adapters 20 and 34. Thus, the scope of the present invention should not be limited to the structures and methods described in this application, but only by the structures and methods described by the language of the claims and the equivalents thereof.

What is claimed is:

1. A gravity fed liquid spraying apparatus comprising:

a spray gun having a through liquid passageway for liquid to be sprayed by said spraying apparatus, and including a connector portion having a cylindrical surface having an axis and defining a bore having an outer end opening through a topside of the spray gun and an inner end communicating with said liquid passageway, said connector portion including a first coupling member external of the bore, adjacent the outer end of the bore, and fixed relative to the cylindrical surface defining the bore;

a liquid supply assembly including walls forming a liquid supply chamber and a cylindrical portion, said cylindrical portion having an axis, a proximal end fixed to one of said walls forming the liquid supply chamber, an opposite distal end, and a through liquid passageway between said proximal and distal ends and communicating with said liquid supply chamber, said cylindrical portion being adapted to be received coaxially in the bore of said connector portion in an engaged position with said distal end of the cylindrical portion adjacent said inner end of the bore, said liquid supply assembly comprising a unitary assembly including said cylindrical portion, said one of said walls to which the proximal end of said cylindrical portion is fixed, and a second coupling member fixed on the unitary assembly relative to the cylindrical portions, said first and second coupling members being shaped and positioned so that with said cylindrical portion and said cylindrical surface coaxial, said cylindrical portion together with the second coupling member can be rotated about said axes relative to the surface defining the bore and said first coupling member between (1) a first relative rotated position at which the cylindrical portion can be moved into said bore to said engaged position in one axial direction and withdrawn from the bore in an opposite axial direction while the first and second coupling members are in relative positions to move past each other, and (2) a second relative rotated position at which, with the cylindrical portion and the surface defining the bore in the engaged position with the cylindrical portion within the bore, the coupling members are engaged with each other to retain the cylindrical portion in the bore; and sealing means for providing liquid tight engagement between the cylindrical portion of the liquid supply assembly and the cylindrical surface defining the bore when the cylindrical portion is within the bore in said engaged position.

2. A gravity fed liquid spraying apparatus according to claim 1 wherein said second coupling member is flexible, and said connector portion has a cam surface that engages and deflects said second coupling member during relative rotation of the cylindrical portion and the surface defining the bore between said first and second relative rotated positions with the cylindrical portion within the bore in the engaged position.

3. A gravity fed liquid spraying apparatus according to claim 1 wherein the walls of the liquid supply assembly forming the liquid supply chamber include walls forming a cup portion, said walls forming the cup portion comprising a generally cylindrical side wall having first and second ends and an end wall extending across and closing the second end of the side wall, and the first end of the cylindrical portion is releasably attached to the transverse wall of said unitary assembly.

4. A gravity fed liquid spraying apparatus according to claim 3 wherein the cup portion has an air inlet opening and the apparatus includes means for opening and closing the air inlet opening.

5. A gravity fed liquid spraying apparatus according to claim 3 wherein the cup portion is of polymeric material and said liquid supply assembly includes a tapered removable pin extending through said side wall of said cup portion adjacent said second end of the side wall, said pin having been pressed through the side wall to form a vent passageway through the side wall, being positioned in the vent passageway to restrict any liquid in the cup portion from moving through the vent passageway, being removable from the vent passageway to allow air to move through the vent passageway into the cup portion adjacent said second end of the side wall, and after such removal being again positionable in the vent passageway to again restrict any liquid in the cup portion from moving through the vent passageway.

6. A gravity fed liquid spraying apparatus according to claim 1 wherein the sealing means comprises a part of the cylindrical portion that is compressed when the cylindrical portion is within the bore.

7. A gravity fed liquid spraying apparatus according to claim 1 wherein the sealing means comprises a sealing ring of resiliently compressible material extending around the cylindrical portion, said sealing ring being compressed radially of the cylindrical portion against the cylindrical surface defining the bore when the cylindrical portion is within the bore.

8. A gravity fed liquid spraying apparatus according to claim 1 wherein the liquid supply assembly is of polymeric material and said sealing means comprises a plurality of axially spaced resiliently compressible sealing rings extending around the cylindrical portion, said sealing rings being compressed radially of the cylindrical portion against the cylindrical surface defining the bore when the cylindrical portion is within the bore.

9. A gravity fed liquid spraying apparatus according to claim 1 wherein the spray gun is portable, includes a frame, and said connector portion having the cylindrical surface defining the bore is releasably connected to the frame of the spray gun.

10. A gravity fed liquid spraying apparatus according to claim 9 wherein the first coupling member is a portion of a radially extending collar on the connector portion, and the second coupling member comprises a hook member having an inwardly projecting lip, the lip on the hook member moving past an opening in the collar when the cylindrical portion is inserted into and withdrawn from the bore with said coupling members in said first relative rotated position, and the lip engaging a surface on said portion of the collar when the coupling members are moved to said second relative rotated position with the cylindrical portion within the bore in the engaged position.

11. A gravity fed liquid spraying apparatus according to claim 10 wherein the second coupling member is one of two of said hook members on opposite sides of said cylindrical portion.

* * * * *